United States Patent [19]

Graber et al.

[11] Patent Number: 4,707,976

[45] Date of Patent: Nov. 24, 1987

[54] OPEN END YARN PIECER

[75] Inventors: Werner Graber; Walter Slavik, both of Horgen, Switzerland

[73] Assignee: Rieter Machine Works, Ltd., Winterthur, Switzerland

[21] Appl. No.: 850,949

[22] Filed: Apr. 11, 1986

[30] Foreign Application Priority Data

Apr. 29, 1985 [GB] United Kingdom ..... 8510842

[51] Int. Cl.[4] ..... D01H 15/02

[52] U.S. Cl. ..... 57/263

[58] Field of Search ..... 57/261-263, 57/22, 405

[56] References Cited

U.S. PATENT DOCUMENTS 4,022,011 5/1977 Hirai ..... 57/263
4,083,171 4/1978 Konig et al. ..... 57/263
4,223,517 9/1980 Husges et al. ..... 57/261
4,356,692 11/1982 Karl et al. ..... 57/263

FOREIGN PATENT DOCUMENTS 0127017 12/1984 European Pat. Off. .
1486161 9/1977 United Kingdom .

*Primary Examiner*—John Petrakes
*Attorney, Agent, or Firm*—Kenyon & Kenyon

[57] ABSTRACT

The yarn reserve forming device is constructed and operated to release a yarn loop for uncontrolled movement from a deflected yarn path into a normal yarn path for return to the withdrawal tube of the spinning machine. The yarn reserve forming device includes a yarn retainer which can be pivoted to release the yarn loop for immediate return to the withdrawal tube.

10 Claims, 6 Drawing Figures

Figure 2I:
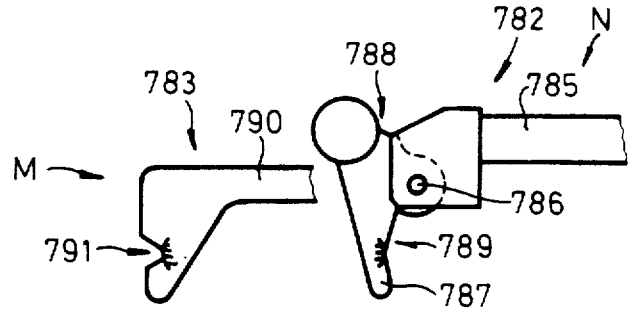
Figure 2:
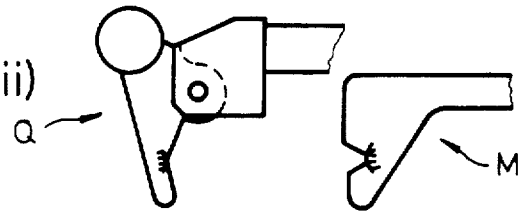
Figure 2:
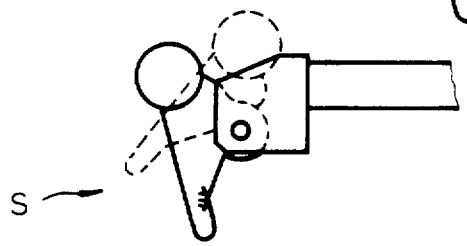
Figure 2V:
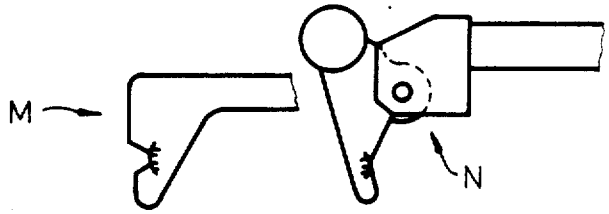

FIG.2(iii)
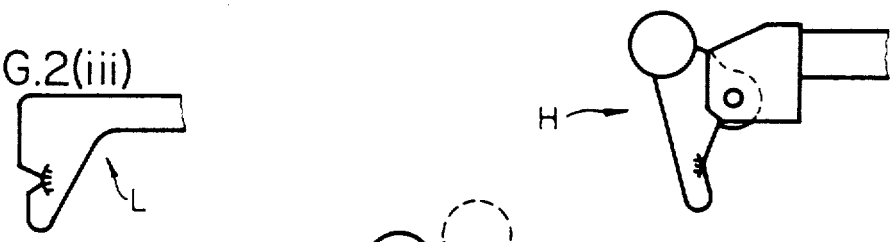

OPEN END YARN PIECER

This invention relates to an open-end yarn piecer. More particularly, this invention relates to a yarn reserve forming device of an open-and yarn piecer. Still more particularly, this invention relates to a method of piecing a spinning unit of a rotor spinning machine.

As is known, yarn spinning machines are generally constructed with a multiplicity of spinning stations at each of which a yarn may be produced and wound onto a spool. In some cases, these machines have been provided with a service tender which can be moved along the spinning stations in order to service each station on an individual basis. For example, tenders have been provided with various types of devices for the re-piecing of a broken yarn or the insertion of a seed yarn into a spinning unit at a given spinning station.

U.S. Pat. No. 4,653,261, British Patent Application No. 83-13993 and corresponding U.S. patent applications Ser. Nos. 611,602 now U.S. Pat. No. 4,689,945; 611,672, now U.S. Pat. No. 4,656,824; and 611,709 now U.S. Pat. No. 4,680,925, each filed May 18, 1984, describe various techniques for piecing a spinning unit of a rotor spinning machine. For example, in a case of a broken yarn, a pair of nip rollers which pull a yarn from the spinning unit are separated and a length of yarn leading to the wind-up spool is led through a yarn reserve forming device. After clamping of the free end of the yarn, the yarn reserve forming device is actuated to create a loop in the yarn and the yarn is clamped at a point between the reserve forming device and the wind-up spool. In this way, a determinate length of yarn is defined between the two clamped points. Thereafter, the free end of the yarn is moved by the first clamp into a position over the withdrawal tube of the spinning unit and the yarn reserve forming device further manipulated to permit feeding of the determinate length of yarn into the withdrawal tube.

Generally, the arrangements described in the above noted patent applications serve to controllably adjust the yarn path during preparations for piecing of a rotor spinning machine. These arrangements are intended for use with a "controlled" final return of the yarn to a rotor groove, for example via a programmed release mechanism, for example as illustrated in FIG. 10 of U.S. Pat. No. 4,653,261. However, it has now been found that equally good results can be obtained with an "uncontrolled" yarn return as generally described in British Pat. No. 1,205,033, that is a thread return which is effected solely under the influence of the suction present in the rotor housing without intervention of an automatic piecing device.

Accordingly, it is an object of the invention to provide an improved piecing device for an open-end yarn piecer.

It is another object of the invention to provide a yarn piecer of simplified construction.

It is another object of the invention to reduce the cost and time for performing a yarn piecing operation in a high speed spinning machine.

Briefly, the invention provides a device for defining and controlling a length of yarn for piecing in an open-end spinning machine. The device includes a plurality of relatively moveable yarn guide elements for defining a yarn path of controllably variable form and length with one of the elements comprising a releasable yarn retainer for releasing a yarn from the yarn path.

The device is used in combiation with a cutting means for cutting a yarn and means for locating a yarn relative to the cutting means for cutting thereat as well as for moving the cut yarn into a predetermined position relative to the guide elements. The guide elements are also moveable relative to each other during movement of the cut yarn in order to maintain taut a predetermined length of yarn extending back from the yarn end.

The device is also used in combination with a spinning unit such that two of the guide elements are moveable to a predetermined position relative to the spinning unit after release of the yarn and from the locating means. In addition, a clamping means is provided upstream of the guide elements in order to determine a predetermined length of the yarn with the cutting means.

The invention also provides a method of piecing a spinning unit of a rotor spinning machine. In accordance with this method, a yarn reserve forming device is initially located relative to a withdrawal tube of the spinning machine. Thereafter, a loop of yarn is formed over a plurality of guide elements of the yarn reserve forming device in order to define a yarn path of controllably variable form and length which is deflected from a normal yarn path. Thereafter, the loop of yarn is released from one of the guide elements in order to permit a return of the yarn directly to the normal yarn path.

During movement of the end of a loop of yarn over the withdrawal tube, the loop of yarn is maintained taut prior to the release of the loop of yarn.

The normal yarn path is characterized as being the normal yarn path taken by the yarn during a normal winding mode. That is, the yarn path extends from the withdrawal tube to a drive roller and, more particularly, to a traversing mechanism at the drive roller.

In contrast to the arrangement described in British Pat. No. 1,205,033, the yarn reserve forming device permits the yarn path to be controlled in a variable manner after the yarn has been engaged with the releasable yarn retainer.

Figure 1:
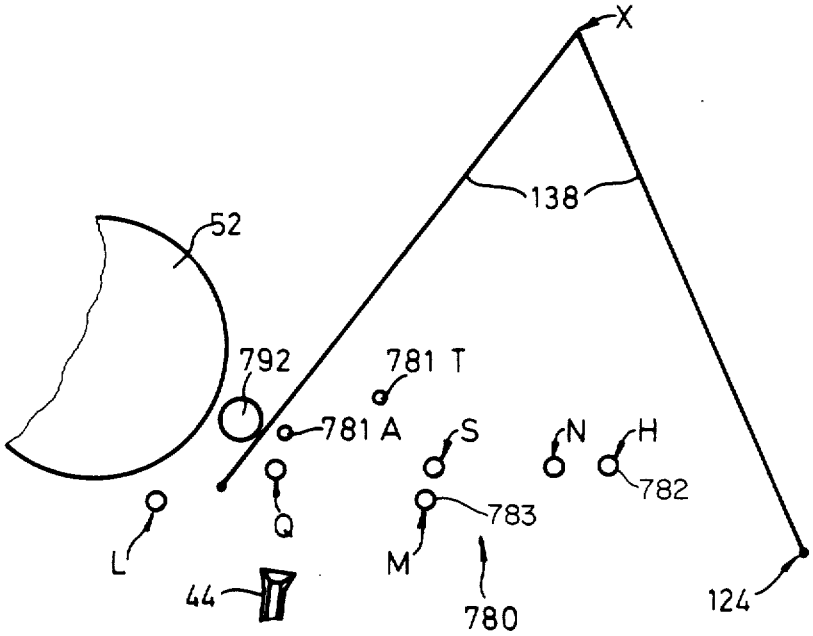

These and other objects and advantages of the invention will become more apparent from the following detailed description taken in conjunction with the accompanied drawings wherein:

FIG. 1 illustrates a diagrammatic side elevational view of a rotor spinning machine according to the invention with indications of varying positions of the elements of a yarn reserve forming device; and FIGS. 2(*i*)–2(*v*) illustrates a sequence of diagramatic plan views of various positional relationships of the guide elements of the yarn reserve forming device in accordance with the invention.

Referring to FIG. 1, the yarn reserve forming device 780 is mounted on a service tender (not shown) so as to be moved along a multiplicity of spinning stations, each of which includes, inter alia, a withdrawal tube 44 of a spinning machine and a drive roller 52 for receiving a yarn from the withdrawal tube 44 after passage through a normal yarn path during a normal winding mode. Apart from the illustrated components of the reserve forming device 780, the remainder of the spinning machine and service tender are as described in U.S. Pat. No. 4,653,261. Accordingly, the descriptions of those components are incorporated by reference herein. Of note, the drive roller 52 (illustrated in part only) is one of a withdrawal roll pair, the pressure roller is not shown. The withdrawal tube 44 by way of which a spun yarn is withdrawn in normal operation from a spinning unit (not shown) is positioned below the withdrawal roll pair. In addition, a lever 38 is pivotly mounted to pivot about an axis X and carries a yarn clamp 24 at a free end. As described in the U.S. Pat. No. 4,653,261, the lever 138 is pivotable between a right-hand position, as viewed, in which a yarn threaded through the clamp 124 is cut to form a defined yarn tail (not shown) which projects from the clamp 124 and a left-hand position, in which the yarn tail is drawn into the withdrawal tube 44 by the suction normally present in the spinning unit.

As also described in U.S. Pat. No. 4,653,261, but not illustrated herein, the yarn to be returned along the withdrawal tube 44 to the spinning unit is also clamped just above the withdrawal roll pair, i.e. downstream from the roll pair as considered with reference to the normal yarn withdrawal path. A determinate length of the yarn is thus produced between the clamp (not shown) and the free end of the tail projecting from the clamp 124.

The yarn reserve device 780 must perform the following functions:

- to assist in definition of the defined length of yarn,
- to hold the defined length of yarn taut during pivoting of lever 138 from the right hand to the left-hand position,
- thereafter to permit return of the length of yarn along the withdrawal tube 44 until the free end of the yarn reaches a predetermined position in relation to the spinning unit ready for the final stages of the piecing operation,
- finally, to release the yarn at a controllable instant during the final stages of the piecing operation so that the free end of the yarn pieces in a desired fashion with fibers newly supplied to the spinning unit.

Referring to FIG. 1, the yarn reserve device 780 includes three guide elements 781, 782, 783 which are movable relative to each other via suitable mechanisms (not shown).

In this regard, the uppermost guide element 781 is movable between a neutral position 781A and a threading position 781T. The middle guide element 782 is movable from a neutral position N to a threading position Q and thereafter to a loop forming position H and finally to a ready position S. The lowermost guide element 783 is movable between a neutral position M and a loop forming position L.

The structure of the uppermost guide element 781 is not particularly shown as this guide element performs only an auxiliary guiding function. Accordingly, the guide element 781 may be constructed in the form of a pin which extends parallel to the drive roller 52.

Referring to FIG. 2 (i), the middle guide element 782 is constructed as a releasable yarn retainer for releasably holding a yarn thereon in a deflected yarn path for release into a normal yarn path as further described below. For example, the guide element 782 includes a rod 785 which is reciprocally mounted to move in a longitudinal direction and which carries a support bracket at one end. The support bracket, in turn, carries a pivot pin 786 which is located on an axis parallel to the axis of the drive roller 52 (not shown). In addition, a lever is pivotally mounted on the pin 786 and comprises a yarn guide portion 787 and an operating portion 788. As indicated, the yarn guide portion 787 has a guide surface 789 which is slightly curved and faces away from the friction roller 52 (not shown).

The lowermost guide element 783 comprises a carrier rod 790 which is reciprocable in parallel to the rod 785 and which carries a side projectio at one end which is provided with a guide surface or notch 791 opening towards the friction roller 52 (not shown), i.e. in an opposite direction to the guide surface 789 of the middle guide element 782.

The guide portions adjacent to the apices of the curved guide surface 789 and notch 791 are so formed that a yarn extending transverse to the drive roller 52 and deflected by these guide portions runs on a subtantially curved surface as viewed in FIG. 1. Accordingly the various positions of the guide elements 781, 782, 783 during the piecing operation are indicated in FIG. 1 by circles which represent diagramatic sections through the yarn contact surfaces at the apices of the notch 791 and guide surface 789.

Referring to FIG. 1, after the service tender carrying the yarn reserve forming device 780 is moved to a selected spinning station, the guide elements 781, 782, 783 are positioned to begin a piecing operation.

First, guide element 781 is moved to the threading position 781T, the releasable yarn retainer 782 is moved to threading position Q and the lowermost guide element 783 is moved to the threading position M. In this condition, a threading element (not shown) can thread the yarn through the device 780 and into the clamp 124 as described in U.S. Pat. No. 4,653,261. After completion of the threading step, the yarn passes between the guide elements 781 and the roller 52; between the guide elements 781, 782; and between the guide elements 782 and 783. The elver 138 is in the right hand position as viewed.

With the clamp 124 still open, the upper guide element 781 is moved to the position 781A while the yarn retainer 782 is moved to position H. The lowermost element 783 remains in position M. Accordingly, a distorted Z-shaped loop of yarn is formed between the upper guide element 781 and the clamp 124 with the yarn contacting the surface 789 while being engaged in the notch 791 (see FIG. 2). The clamps upstream and downstream of the device 780 are then closed and the required length of yarn is defined by the disposition of the device 780 relative to the clamps and the disposition of the clamp 124 relative to the cutting means (not shown).

After cutting of the yarn, the lever 138 is pivoted to the left hand position and the newly formed yarn tail is thereby introduced into the withdrawl tube 44. The position of the non-illustrated clamp downstream from the withdrawal roller pair is fixed. In order to hold the yarn taut during this movement of the lever 138, the lowermost element 783 is moved linearly to the position L while the yarn retainer 782 remains in the position H. Accordingly, a differently distorted Z-shape of loop in formed in the device 780.

The clamp 124 is now released and the lever 138 returned to the right hand position leaving the yarn free for return along the tube 44. Initial return of the yarn is effected by moving the lower guide element 783 back to the position M, while moving the yarn retainer 782 to a position "S" closely above the lowermost element 783. Throughout these movements, the upper guide element 781 remains in the position "A".

The yarn is now in a "ready" condition in which the free yarn end lies at a predetermined position relative to the spinning unit ready for the final return during the final stages of the piecing operation. The form of the yarn loop in the device 780 is, however, different from that shown in the unit 78 in FIG. 9 of U.S. Pat. No. 4,653,261 and the final return is effected differently. Before that operation is described, the previously described steps will be related to the diagrams of FIG. 2.

FIG. 2 contains five diagrams arranged one above the other and identified as (i) to (v) respectively. In Diagrams 2(i) and 2(v) the guide elements 782 and 783 are in the respective neutral positions in which they are located when the device 780 is not in use, thereby ensuring avoidance of interference with other equipment in the piecing apparatus. The neutral position of the lowermost element 783 is the position M already described and indicated in FIG. 1. The neutral position of the yarn retainer 782 is indicated at N in both FIGS. 1 and 2.

In Diagram 2 (ii), the yarn retainer 782 has been shifted to position Q as described above while element 783 is still in position M. The device 780 is in the threading position.

Diagram 2 (iii) represents the result of two separate steps following the condition of Diagram 2 (ii). In the first step, yarn retainer 782 is moved to the loop forming position H, so that the first Z-shaped loop is formed, while the lower element 783 remains in position M. In the second step, the lower element 783 moves to position L to form the second Z-shaped loop while the yarn retainer 782 remains in position H.

Diagram 2 (iv) shows the yarn retainer 782 in position S, at which time, the lower element 783 is in position M again and has been omitted from the diagram to avoid confusion. In Diagram 2 (iv), the full line illustration represents element 782 acting as a retainer for the yarn, as in diagram 2 (iii), whereas the dotted line illustration represents a release position in which the yarn has been freed to return to the normal withdrawal path as will be described further below.

Although not essential to the present invention, Fig. 1 illustrates a traversing mechanism in the form of a traverse rod 792 which extends parallel to the roller 52 and is provided with a guide notch (not shown) to guide the yarn during normal operation. The rod 792 is reciprocated back and forth through a short stroke parallel to the drive roller 52 and thus distributes wear on the roller pair. The rod 792 and its function are well known and need not be further described. The significance of the rod 792 in the present context is that the normal withdrawal path is defined between the tube 44 and the guide notch in the rod 792 while the yarn path defined by the elements 781, 782 and 783 represents a deflected path from this normal withdrawal path to which the yarn will return under the suction effect of the spinning unit as soon as the yarn is released by the device 780.

In the present system, the yarn loop in the yarn reserve forming device 780 in the ready condition is defined by the guide element 781 and yarn retainer 782 and the position of the latter relative to the lip of the tube 44. Position M is so arranged relative to position S and the tube lip, that the yarn extending directly form the yarn retainer 782 to the tube 44 has already moved out of contact with the lower element 783.

At the appropriate instant in the final stages of the piecing operation, a suitable operating mechanism is operated and acts on the operating portions 788 (FIG. 2) of the yarn retainer 782 to pivot the lever in a clockwise direction as viewed in FIG. 2 about the pin 786 as seen in Diagram 2(iv). The degree of pivoting is sufficient to release the yarn, and the speed of pivoting is sufficient to ensure that the guide does not interfere with free movement of the yarn under the influence of the suction of the spinning unit. The principles of such an action are shown in British Pat. No. 1,205,033 and the actual piecing operation is described in U.S. Pat. No. 4,653,261, so that no further description of the yarn movement is believed necessary. It is noted, however, that the return of the yarn to its normal withdrawal path automatically implies movement of the yarn off the upper guide element 781 in the position A, so that the latter can be returned to the threading position T ready for the next operation.

Pivoting of the lever of the yarn retainer 782 on the support bracket can be effected by any convenient means, for example, a connector rod (not shown) may be pivotally linked to the lever and may extend back along the rod 785 to a suitable source of motive power, such as an electromagnet or pneumatic element. The lever may also be biased towards the yarn retaining position, and/or releasably retained in such position e.g. by a detent mechanism between the lever and the bracket.

The length of yarn defined by the system may be made controllably adjustable by adjusting the relative positions of the guide elements 781,782,783 in the length defining phase (prior to closure of the clamps). Preferably, this involves a change in position of only one element within the device 780, and this is conveniently the element 782, the position H of which may be selectively adjustable relative to positions A and M of the other elements 781,783. This enables adaptation of the device to alternative types of spinning units e.g. with different rotor diameters.

Movement of the elements 781,782, 783 between the described positions is conveniently effected by a cam and follower sequence control system similar to that indicated diagrammatically at 123 in FIG. 7 of U.S. Pat. No. 4,653,261.

The system illustrated in the drawings is simpler than the corresponding system shown in U.S. Pat. No. 4,653,261 and yet produces a piecing success rate as good as that achieved with the prior system. In particular, the new arrangement is easier to set up and adjust, and is less liable to variation in performance over time.

The invention is not limited to details of the illustrated embodiments. For example, the form of the yarn guiding retaining elements, and the arrangements for moving them, can be adapted to the circumstances. Release of the yarn for return under suction without intervention of the reserve forming device can be effected at any stage after the yarn tail has been safely inserted into the tube 44, provided that the danger of snarls forming in the tube 44 is avoided or not present, and provided that the yarn retainer can be moved out to the thread path sufficiently quickly to allow unhindered return of the yarn.

The yarn length definition and control function could of course be separated from the release function, but this would involve additional elements and coordination problems.

What is claimed is:

1. In combination, a first yarn clamp for engaging a length of yarn for a piecing operation;

a second yarn clamp for engaging the length of yarn and being movable between a first position and a second position;

means at said first position to create a prepared yarn end in a yarn held in said second yarn clamp thereat for piecing; and a plurality of relatively movable guide elements between said clamps for defining a yarn path of controllably variable form and length, one of said guide elements being movable into a position to permit backfeeding of the yarn end to a predetermined position following release of the yarn end from said second yarn clamp and a second of said guide elements comprising a releasable yarn retainer for releaseing a yarn from said path to permit free movement of the yarn end from said predetermined position.

2. The combination as set forth in claim 1 which further comprises a spinning machine having a withdrawal tube for passage of a spun yarn therefrom and wherein said second position of said second yarn clamp is disposed above said tube.

3. The combination as set forth in claim 2 wherein said releaseable yarn retainer is laterally spaced from said tube to define a yarn loop disposed for free release into a normal yarn extending from said tube.

4. In combination, a withdrawal tube of a spinning machine;

a drive roller for receiving a yarn from said withdrawal tube after passage through a normal yarn path during a normal winding mode;

a first yarn clamp above said drive roller for engaging a yarn;

a second yarn clamp for engaging the yarn and being movable between a first position above said tube and a second position spaced from said tube;

means at said second position to create a yarn tail in a yarn held in said second yarn clamp thereat;

a yarn reserve forming device selectively positioned between said drive roller and said tube and within said yarn path, said device including a plurality of relatively movable guide elements for defining a deflected yarn path of variable form and length, one of said guide elements being movable into a position spaced from said tube to permit backfeeding of the yarn tail into a predetermined position in said tube following release of the yarn tail from said second clamp in said first position and a second of said guide elements including a releaseable yarn retainer for releasing the yarn from said deflected yarn path and into said normal yarn path while permitting free movement of the yarn into said normal path while permitting free movement of the yarn tail further into said tube for a piecing operation.

5. The combination as set forth in claim 4 wherein said yarn retainer includes a pivotally mounted lever having a yarn guide surface facing away from said drive roller and disposed to receive and deflect a yarn thereon.

6. The combination as set forth in claim 5 wherein said yarn retainer includes a reciprocally mounted rod connected to said lever to pivot said lever into a position to release a yarn thereon into said normal yarn path.

7. The combination as set forth in claim 4 wherein said yarn retainer is movable from a threading position to a yarn loop forming position and to a ready position between said threading position and said yarn loop forming position for release of a yarn from said ready position into said normal yarn path.

8. In combination, a withdrawal tube of a spinning machine;

a drive roller for receiving a yarn from said withdrawal tube after passage through a normal yarn path during a normal winding mode; and a yarn reserve forming device selectively positioned between said drive roller and said tube and within said yarn path, said device including a pair of guide elements and a yarn retainer movably mounted to move between a threading position spaced from one side of said guide elements to a loop forming position spaced on an opposite side and said guide elements to deflect a yarn over said retainer and said guide elements, said yarn retainer being movable to a ready position between said threading position and said loop forming position to release a yarn therefrom into said normal yarn path, said yarn retainer including a pivotally mounted lever having a yarn guide surface facing away from said driver roller and disposed to receive and deflect a yarn thereon and a reciprocally mounted rod connected to said lever to pivot said lever into a position to release a yarn thereon into said normal yarn path.

9. The combination as set forth in claim 8 which further includes a lever having a clamp thereon for engaging a yarn at one end thereof, said lever being pivotal to position the yarn end over said withdrawal tube and one of said guide elements being movable from a neutral position to a loop forming position during movement of said lever towards said tube to hold a yarn taut there betewen.

10. A method of piecing a spinning unit of a rotor spinning machine having a multiplicity of spinning units comprising the steps of locating a yarn reserve forming device relative to a withdrawal tube of a selected spinning machine;

clamping a yarn at two points thereof on respective opposite sides of the yarn reserve forming device;

forming a loop of yarn between the two clamped points and over a plurality of guide elements of the yarn reserve forming device to define a yarn path of controllably variable form and length deflected from a normal yarn path;

moving an end of the loop of yarn over the withdrawal tube while maintaining the yarn taut between said two points; releasing the yarn from a clamped point above the withdrawal tube to permit backfeeding of the yarn end into a predetermined position in the tube; and thereafter releasing the loop of yarn from one of the guide elements to permit return of the yarn directly to said normal yarn path and free movement of the yarn end further into the withdrawal tube.

* * * * *

UNITED STATES PATENT AND TRADEMARK OFFICE

CERTIFICATE OF CORRECTION

PATENT NO. : 4,707,976

DATED : November 24, 1987

INVENTOR(S) : Werner Graber , et al

It is certified that error appears in the above-identified patent and that said Letters Patent is hereby corrected as shown below:

Column 1, line 6 "open-and- should be -open-end-
Column 2, line 1 "comiation" should be -combination-
Column 2, line 44 "accompanied" should be -accompanying-
Column 2, line 49 "diagramatic" should be -diagrammatic-
Column 3, line 2 "38" should be -138-
Column 3, line 2 "pivotly" sholud be -pivotally-
Column 3, line 3 "24" should be -124-
Column 4, line 3 "projectio" should be -projection-
Column 4, line 15 "diagramatic" should be -diagrammatic-
Column 4, line 32 "elver" should be - lever-
Column 4, line 49 "withdrawl" should be -withdrawal-
Column 4, line 55 "in" should be -is-
Column 7, line 13 "releaseing" should be -releasing-
Column 7, lines 51, 53 cancel "into ... yarn"
Column 8, line 20 "and" should be -of-
Column 8, line 40 "there betewen" should be -therebetween-

Signed and Sealed this

Seventh Day of June, 1988

*Attest:*

*Attesting Officer*

DONALD J. QUIGG

*Commissioner of Patents and Trademarks*